US007863532B2

(12) United States Patent
Cao

(10) Patent No.: US 7,863,532 B2
(45) Date of Patent: Jan. 4, 2011

(54) ILLUMINATED KEYPAD ASSEMBLY

(75) Inventor: Jin-Ti Cao, Shenzhen (CN)

(73) Assignees: Shenzhen Futaihong Precision Industry Co., Ltd., ShenZhen, Guangdong province (CN); FIH (Hong Kong) Limited, Kowloon (HK)

( * ) Notice: Subject to any disclaimer, the term of this patent is extended or adjusted under 35 U.S.C. 154(b) by 92 days.

(21) Appl. No.: 12/327,488

(22) Filed: Dec. 3, 2008

(65) Prior Publication Data

US 2010/0018848 A1 Jan. 28, 2010

(30) Foreign Application Priority Data

Jul. 23, 2008 (CN) ..... 2008 1 0302947

(51) Int. Cl.
*H01H 9/00* (2006.01)

(52) U.S. Cl. ..... 200/310

(58) Field of Classification Search ..... 200/310, 200/314

See application file for complete search history.

(56) References Cited

U.S. PATENT DOCUMENTS 6,217,183 B1 * 4/2001 Shipman ..... 362/30
7,154,059 B2 * 12/2006 Chou ..... 200/314
2007/0235306 A1 * 10/2007 Chiba et al. ..... 200/314

* cited by examiner

*Primary Examiner*—Edwin A. Leon
*Assistant Examiner*—Vanessa Girardi
(74) *Attorney, Agent, or Firm*—Steven M. Reiss

(57) ABSTRACT

A key assembly (10) for use in a electronic device is provided. The key assembly (10) comprises a light guiding plate (18), a keypad (12), and a key seat (14). The key seat (14) has a number of positioning poles (1442). The light guiding plate (18) defined a number of aligning holes (184) corresponding to the positioning poles (1442) and the positioning poles (1442) pass through the aligning holes (184).

5 Claims, 4 Drawing Sheets

ILLUMINATED KEYPAD ASSEMBLY

BACKGROUND

1. Field of the Invention

The present invention relates to keypad assemblies, particularly to keypad assemblies for electronic devices.

2. Description of Related Art

A typical key assembly may usually include a keypad, a rubbery plate that can be resiliently deformed to accumulate resilient force as pressing the keypad, and a light guiding plate for illuminating the keypad. The light guiding plate is positioned between the keypad and rubbery plate.

However, the keypad, the rubbery plate, and the light guiding plate are typically adhered (e.g., by an adhesive) together without precise positioning.

Therefore, there is room for improvement within the art.

BRIEF DESCRIPTION OF THE DRAWINGS

Many aspects of the exemplary key assembly can be better understood with reference to the following drawings. These drawings are not necessarily drawn to scale, the emphasis instead being placed upon clearly illustrating the principles of the present methods. Moreover, in the drawings like reference numerals designate corresponding parts throughout the several views. Wherever possible, the same reference numbers are used throughout the drawings to refer to the same or like elements of an embodiment.

DETAILED DESCRIPTION OF THE EXEMPLARY EMBODIMENTS

Figure 1:
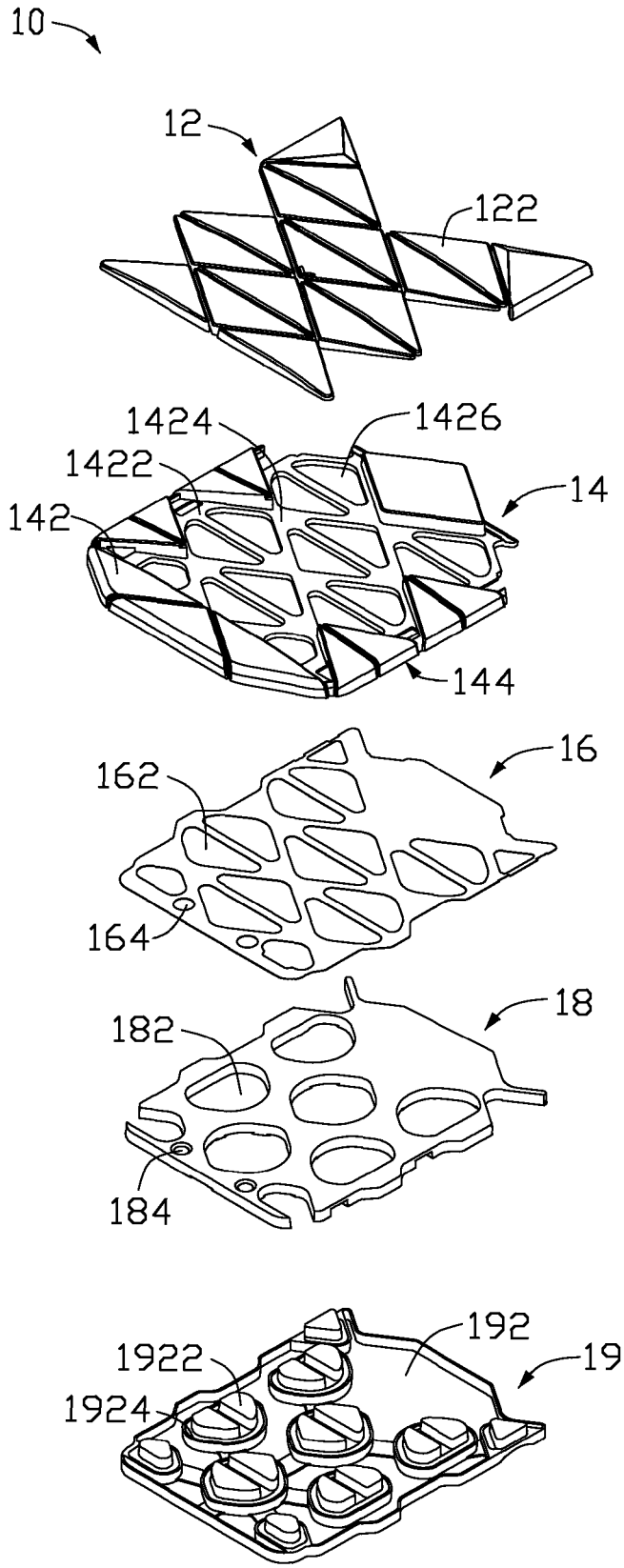
FIG. 1 is a schematic and exploded view of a key assembly in accordance with an exemplary embodiment, showing one aspect.

FIG. 1 shows an exemplary key assembly 10 including a keypad 12, a key seat 14, a shading plate 16, a light guiding plate 18, and a rubbery plate 19.

The keypad 12 including a plurality of keys 122 made of e.g., polycarbonate (PC), or other thermoplastic materials including polymethyl methacrylate and polystyrene.

Figure 2:
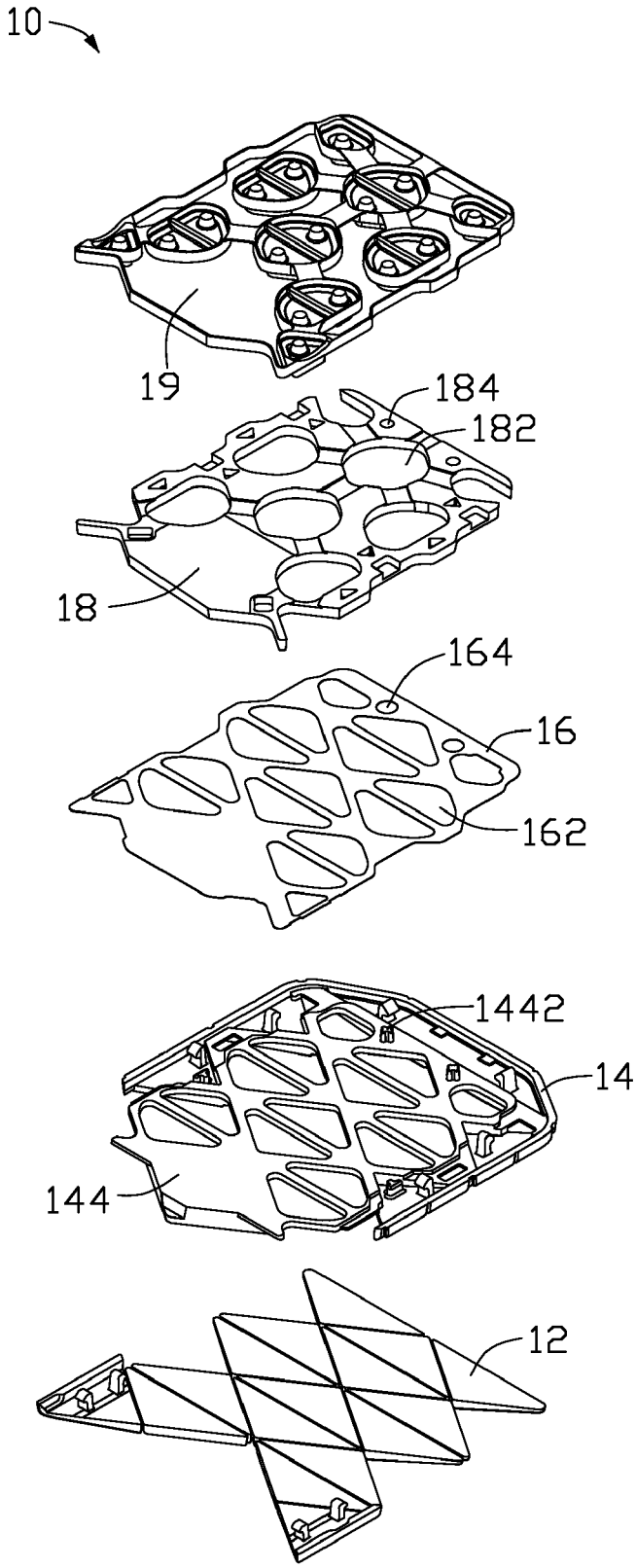
FIG. 2 is a schematic and an exploded view of the key assembly shown in FIG. 1, showing another aspect.

The key seat 14 includes a first surface 142 and an opposite second surface 144 (shown in FIG. 2). The key seat 14 has a concave portion 1422 defined in the first surface 142 and a lower surface 1424 defined as the base of the concave portion 1422. The concave portion 1422 has substantially the same shape and size as the keypad 12 and accommodates the keypad 12 therein. The lower surface 1424 defines a plurality of apertures 1426. Each aperture 1426 corresponds to a key 122. Each aperture 1426 has substantially the same shape as its corresponding key 122 and a size slightly smaller than its corresponding key 122. The key seat 14 has a plurality of positioning poles 1442 protruding from the second surface 144. The positioning poles 1442 are used to fixedly align and attach the key seat 14, the shading plate 16, and the light guiding plate 18 together. The key seat 14 may be made of one or more materials selected from a group consisting of polyvinyl chloride (PVC), polycarbonate, polystyrene, and any other thermoplastic resins.

The shading plate 16 defines a plurality of openings 162 and a plurality of positioning holes 164. Each opening 162 corresponds to a key 122. Each positioning hole 164 corresponds to a positioning pole 1442. The shading plate 16 configured to attach (e.g., adhesive) to the second surface 144 of the key seat 14. The shading plate 16 can be made of an opaque, black color material (e.g., the mixture of resin and carbon).

The light guiding plate 18 has a plurality of orifices 182 and a plurality of aligning holes 184. Each orifice corresponds to a key 122. Each aligning hole 184 corresponds to a positioning pole 1442. The light guiding plate 18 is positioned between the shading plate 16 and the rubbery plate 19. The light guiding plate 18 can be made of one or more materials selected from a group consisting of polyvinyl chloride (PVC), polycarbonate, polystyrene, and any other thermoplastic resins.

The rubbery plate 19 includes a surface 192 facing the light guiding plate 18. The rubbery plate 19 has a plurality of protrusions 1922 protruding from the surface 192 and a plurality of fixing portions 1924. Each fixing portion 1924 surrounds a corresponding protrusion 1922. The fixing portions 1924 have substantially the same shape and size as the orifices 182 and are configured to be accommodated within the orifices 182.

Figure 3:
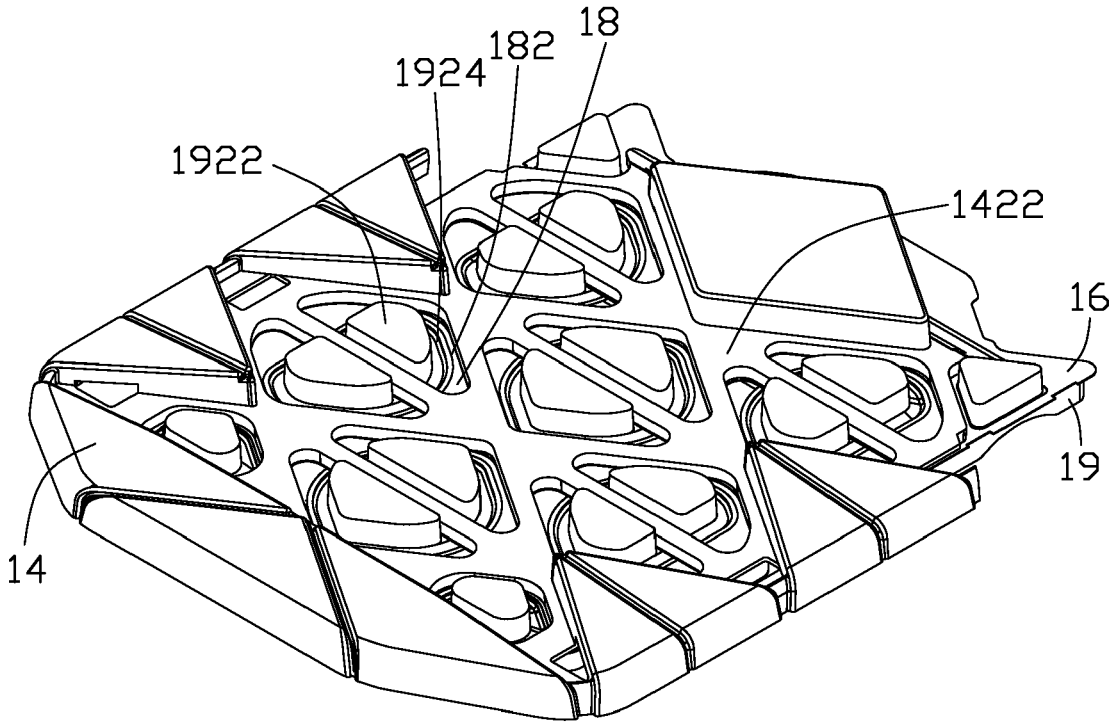
FIG. 3 is a schematic and assembled view of the key assembly without a keypad shown in FIG. 1.
Figure 4:
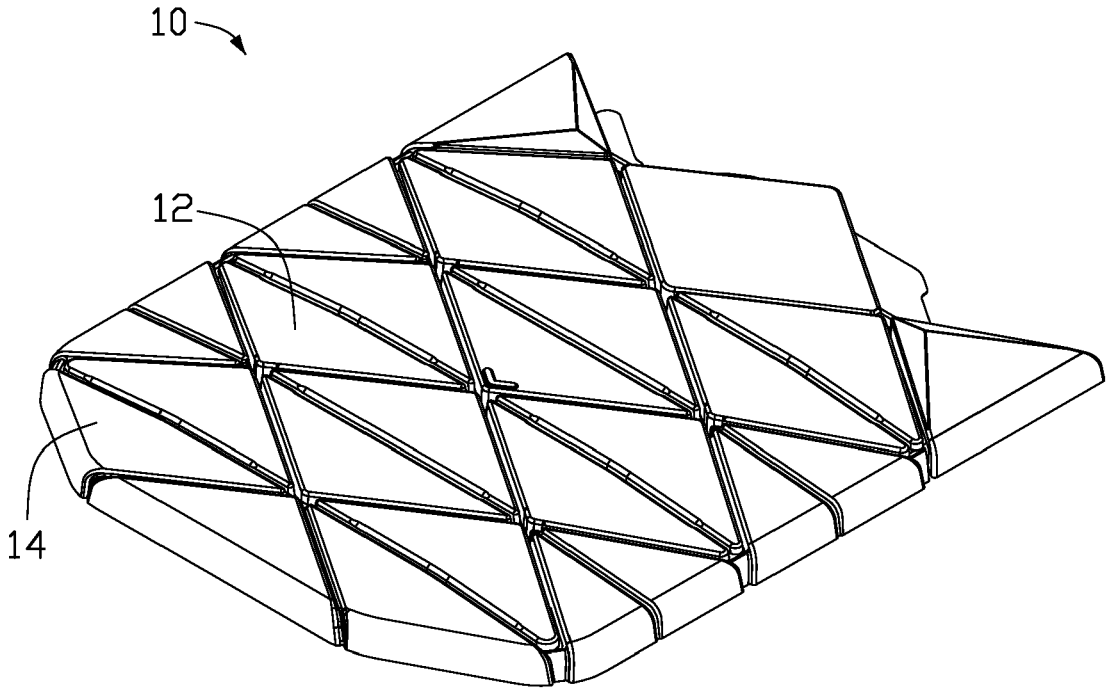
FIG. 4 is a schematic and assembled view of the housing shown in FIG. 1.

Referring to FIGS. 3 and 4, to assemble the key assembly 10, the protrusions 1922 are aligned with the orifices 182 of the light guiding plate 18 and the light guiding plate 18 is pressed toward the rubbery plate 19. During this stage, the protrusions 1922 pass through the orifices 182 until the fixing portions 1924 are securely received in the orifices 182 and the light guiding plate 18 is frictionally attached to the rubbery plate 19. Then, the openings 162 are aligned with the protrusions 1922 and the shading plate 16 is pressed toward the light guiding plate 18 until the protrusions 1922 pass through the openings 162 and the shading plate 16 attaches to the light guiding plate 18. The positioning poles 1442 are aligned with the positioning holes 164 and the aligning holes 184. During this step, the apertures 1426 are aligned with the protrusions 1922. Next, by pressing the key seat 14 toward the shading plate 16, the protrusions 1922 pass through the apertures 1426, and the positioning poles 1442 pass through the positioning holes 164 and the aligning holes 184 until the key seat 14 attaches to the shading plate 16 due to the press-fit between the positioning poles 1442 and the positioning holes 164 and the aligning holes 184. The keypad 12 is accommodated in the concave portion 1422 to attach the keypad 12 to the key seat 14.

The concave portion 1422 has substantially the same shape and size as the keypad 12, so the keypad 12 can be precisely positioned within the key seat 14. In addition, the positioning poles 1442, the location holes 164, and the aligning holes 184 are used to fixedly align and attach the key seat 14, the shading plate 16, and the light guiding plate 18 together.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminated key assembly for use in an electronic device, comprising:

a light guiding plate;

a keypad comprising a number of keys;

a key seat including a first surface and an opposite second surface, the key seat having a concave portion defined on the first surface, the keypad accommodated in the concave portion, the key seat having positioning poles protruding outwardly, the light guiding plate defining a number of aligning holes corresponding in size and number to the positioning poles, the positioning poles passing through in the aligning holes, the key seat having a number of apertures corresponding in size and number to the keys; and a key assembly including a shading plate, the shading plate disposed between the key seat and the light guiding plate, the shading plate defining positioning holes corresponding in size and number to the positioning poles, the positioning poles passing through the positioning holes;

wherein the light guiding plate has a number of orifices corresponding in size and number to the keys, the shading plate has a number of openings corresponding in size and number to the keys.

2. The illuminated key assembly as claimed in claim 1, wherein the key assembly further includes a rubbery plate, the light guiding plate has a surface opposite from the key seat, the rubbery plate frictionally attached to said opposite surface.

3. The illuminated key assembly as claimed in claim 2, wherein the rubbery plate has a number of protrusions corresponding to the keys, and the protrusions pass through the orifices, the openings, and the apertures.

4. The illuminated key assembly as claimed in claim 3, wherein the rubbery plate has a number of positioning portions surrounding the protrusions, and the positioning portions are securely received in the orifices.

5. An illuminated key assembly for use in an electronic device, comprising:

a keypad comprising a number of keys;

a key seat including a first surface and an opposite second surface, the key seat having a concave portion defined on the first surface, the keypad accommodated in the concave portion, the key seat having positioning poles protruding outwardly, the key seat defining a number of apertures;

a shading plate defining positioning holes and defining a number of openings; and a light guiding plate defining aligning holes and orifices;

wherein a size and number of the apertures, the orifices, and the openings corresponds to that of the keys, the positioning poles orderly passes through positioning holes and the aligning holes to attach the key seat to the shading plate.

* * * * *